US009552802B2

(12) United States Patent
Jang

(10) Patent No.: US 9,552,802 B2
(45) Date of Patent: Jan. 24, 2017

(54) ELECTROMAGNETIC PICKUP FOR STRINGED INSTRUMENTS

(71) Applicant: Changsoo Jang, San Jose, CA (US)

(72) Inventor: Changsoo Jang, San Jose, CA (US)

(73) Assignee: Changsoo Jang, San Jose, CA (US)

( * ) Notice: Subject to any disclaimer, the term of this patent is extended or adjusted under 35 U.S.C. 154(b) by 0 days.

(21) Appl. No.: 14/315,336

(22) Filed: Jun. 26, 2014

(65) Prior Publication Data

US 2015/0379978 A1 Dec. 31, 2015

(51) Int. Cl.
*G10H 3/18* (2006.01)
*G10H 3/14* (2006.01)
*G10H 3/00* (2006.01)

(52) U.S. Cl.
CPC ..... *G10H 3/181* (2013.01); *G10H 3/00* (2013.01); *G10H 3/14* (2013.01); *G10H 3/143* (2013.01); *G10H 3/18* (2013.01); *G10H 3/182* (2013.01); *G10H 2220/515* (2013.01)

(58) Field of Classification Search
CPC ..... G10H 3/00; G10H 3/18; G10H 3/181; G10H 3/14; G10H 3/143
USPC ..... 84/726
See application file for complete search history.

(56) References Cited

U.S. PATENT DOCUMENTS 2,896,491 A * 7/1959 Lover ..... G10H 3/181 84/725
3,711,619 A * 1/1973 Jones ..... G10H 3/181 84/726
4,364,295 A * 12/1982 Stich ..... G10H 3/181 84/726
4,372,186 A * 2/1983 Aaroe ..... G10H 3/181 84/725
5,111,728 A * 5/1992 Blucher ..... G10H 3/182 84/726
5,378,850 A * 1/1995 Tumura ..... G10H 3/26 84/727
5,408,043 A * 4/1995 Lace ..... G10H 3/181 84/726
5,525,750 A * 6/1996 Beller ..... G10H 3/182 84/726
5,530,199 A * 6/1996 Blucher ..... G10H 3/181 84/728
5,811,710 A * 9/1998 Blucher ..... G10H 3/181 84/728
5,932,827 A * 8/1999 Osborne ..... G10H 3/18 84/726
6,103,966 A * 8/2000 Kinman ..... G10H 3/181 84/728
6,291,758 B1 * 9/2001 Turner ..... G10H 3/181 336/110

(Continued)

*Primary Examiner* — David Warren
*Assistant Examiner* — Christina Schreiber

(57) ABSTRACT

An electromagnetic pickup for electric guitars has one or two dual-coil assemblies wherein an inner coil is wound around a bobbin and then an outer coil around the inner coil. In the dual-coil assembly the inner coil replaces the entire or part of wall space of pole piece holes in a plastic molded bobbin. The outer and inner coils in the dual-coil assembly are electrically connected in-phase to produce single coil pickup sound. The outer coil or the serially connected inner and outer coils are connected to a coil in the other pole piece/bobbin/coil assembly out-of-phase to generate hum-bucking pickup sound.

9 Claims, 10 Drawing Sheets

(56) References Cited

U.S. PATENT DOCUMENTS

| | | | | |
|---|---|---|---|---|
| 6,291,759 | B1 * | 9/2001 | Turner | G10H 3/181 336/110 |
| 6,525,258 | B1 * | 2/2003 | Powers | G10H 3/182 84/728 |
| 7,189,916 | B2 * | 3/2007 | Kinman | G10H 3/181 84/726 |
| 8,309,836 | B1 * | 11/2012 | Bolger | G10H 3/143 84/723 |
| 8,319,088 | B1 * | 11/2012 | Harari | G10H 3/181 84/727 |
| 8,802,959 | B2 * | 8/2014 | Mills | G10H 3/181 84/726 |
| 8,969,701 | B1 * | 3/2015 | Dixon | G10H 3/143 84/723 |
| 2002/0069749 | A1 * | 6/2002 | Hoover | G10H 3/26 84/738 |
| 2004/0003709 | A1 * | 1/2004 | Kinman | G10H 3/181 84/728 |
| 2006/0156911 | A1 * | 7/2006 | Stich | G10H 3/181 84/726 |
| 2007/0017355 | A1 * | 1/2007 | Lace | G10H 3/181 84/728 |
| 2012/0103170 | A1 * | 5/2012 | Kinman | G10H 3/181 84/726 |
| 2012/0118129 | A1 * | 5/2012 | Jang | G10H 3/143 84/726 |
| 2013/0327202 | A1 * | 12/2013 | Mills | G10H 3/181 84/726 |
| 2014/0245877 | A1 * | 9/2014 | Gelvin | G10H 3/181 84/727 |

* cited by examiner (a)

(b)

(a)

(b)

(a)

(b)

ELECTROMAGNETIC PICKUP FOR STRINGED INSTRUMENTS

This application is a continuation-in-part of application no. 2012/0118129, filed on Nov. 16, 2010, now abandoned.

BACKGROUND OF THE INVENTION

An electromagnetic pickup (pickup, hereinafter) converts the vibrations of plucked strings of an electric guitar, which are located on top of the pickup where electromagnetic fields are formed, into an electrical signal. In general a single coil pickup (SC pickup, hereinafter) comprises of a set of pole pieces made of magnetic or ferromagnetic materials, magnetic wire coil, bobbin plates, and lead wires. The SC pickup is sensitive to external magnetic fields created by speakers, power transducers, fluorescent light sources and so on, resulting in undesired humming noise.

Such humming noise can be reduced or eliminated by combining two magnetic sensing coils electrically out-of-phase so that two signals generated by the external sources can be cancelled each other. The electromagnetic signal from guitar strings can be preserved either by setting the two coils magnetically out-of-phase or by isolating one of the two coils magnetically from the strings.

Overall, there are two structural configurations—1) side-by-side configuration, wherein two coils are situated side-by-side and are both electrically and magnetically out-of-phase (U.S. Pat. No. 2,896,491, U.S. Pat. No. 4,364,295, U.S. Pat. No. 4,372,186, U.S. Pat. No. 4,501,185, U.S. Pat. No. 5,111,728, U.S. Pat. No. 5,525,750, U.S. Pat. No. 5,530,199, U.S. Pat. No. 8,309,836, US Pat. Appl. No. US 2012/0103170, and so on), and 2) stacked configuration, wherein two coils are stacked on top of each other and are both electrically and magnetically out-of-phase like the former (U.S. Pat. No. 6,846,981), or electrically out-of-phase and magnetically in-phase with magnetic isolating means for one coil (U.S. Pat. No. 4,442,749, U.S. Pat. No. 5,168,117, U.S. Pat. No. 5,668,520, U.S. Pat. No. 5,811,710, U.S. Pat. No. 6,103,966, U.S. Pat. No. 6,291,758, U.S. Pat. No. 6,291,759, U.S. Pat. No. 6,846,981, U.S. Pat. No. 7,166,793, U.S. Pat. No. 7,189,916, and so on).

The most popular hum-cancelling pickup with the side-by-side configuration was introduced by Lover (U.S. Pat. No. 2,896,491). The pickups built according to this invention have been called PAF (Patent Applied For), which was printed on the bottom plate of those pickups in the early days. In this document the hum-cancelling pickup with the side-by-side configuration is referred to simply as the HB (Hum-Bucking) pickup, hereinafter. It is to be noted that the hum-cancelling pickup with the stacked configuration will be referred to as the stacked hum-cancelling pickup.

A pickup has a unique response characteristic to string vibrations resulting in a unique tone color. Pickup tone is dependent on many parameters, which include magnet materials, pole pieces, bobbin materials and structures, magnet wire gage, magnet wire coating materials, the number of wire turns and so on. Although external factors such as guitar builds, effects pedals and amplifiers can color the tone characters to some extent, they cannot completely override the original tone of the pickup. That is why old classical pickups including the said PAF are still popular, and also, a number of different pickup products are available in the music industry.

Two most distinctive tone colors are generated from aforementioned SC and HB pickups. The SC pickup usually produces a clear and bright sound with a focus on the treble to mid-range domain, whereas the HB pickup produces a warm and thick sound with a focus on the mid-range domain. The majority of electric guitar players use both types of pickups depending on the needs. Because it is inconvenient and impractical to change guitars for different pickup sounds in the middle of performance, many guitar builders and pickup makers offer the option of "coil-splitting", by which a guitar player can use only one of the two coils in the HB pickup, or more rarely "combining", in which two individual SC pickups are electrically connected like one HB pickup. However, both methods do not deliver a purposed SC or HB sound very well. A coil-split pickup sound is typically thinner and less lively than a genuine SC pickup sound. On the other hand, a combination of two genuine SC pickups does not usually produce a good HB pickup sound defined by warmth and fullness. As a result, pickups that can produce both HB and SC sounds are hardly found.

From a set of experiments it was found that one of the most critical factors, which make the difference in sound characteristics between a genuine SC pickup and a coil-split HB pickup, was the space between the coil and the pole pieces and that such space in the HB pickup can be made closer to that of the SC pickup without damaging or changing the sound characteristics and form factor of the HB pickup. The details of this invention and embodiments are described in the next sections.

SUMMARY OF THE INVENTION

This invention is about a method to wind the HB pickup to obtain a clear and bright SC-like pickup sound from one of its pole piece/bobbin/coil assemblies. At least one of the two pickup bobbins is made such that the surface of pole pieces is in contact with the innermost wires of a coil, or the distance between the two is closer than that of the traditional HB pickup. This can be made possible by eliminating or thinning the wall of pole piece holes in a molded plastic bobbin. An inner coil is wound around a bobbin such that the space occupied by the pole piece hole wall is now filled with the inner coil. An outer coil is then wound on top of the inner coil according to a designated HB winding specification. The outer coil or the serially connected inner and outer coils are electrically connected to a coil wound around the other bobbin to obtain a HB pickup sound, whereas the inner and outer coils wound around the same bobbin are electrically connected in-phase to produce a SC pickup sound. In effect this invention makes the HB pickup and the electric guitar employing one or plural of them versatile in terms of tonal variations.

BRIEF DESCRIPTION OF THE DRAWINGS

Note that the schematics used in this document are not to scale. This document assumes all the electrical connections shown in the figures follow the well-established art of HB pickup wiring (e.g., in-phase and out-of-phase wiring), and thus, phase information is not specified in the drawings. This document also assumes that all embodiments of this invention follow the known art of magnet, pole piece dispositions, and other miscellaneous items including spacers and screw holders within the HB pickup (based on Lover's patent, 1959), which have been well established, published and commercialized.

DETAILED DESCRIPTION

Figure 1:
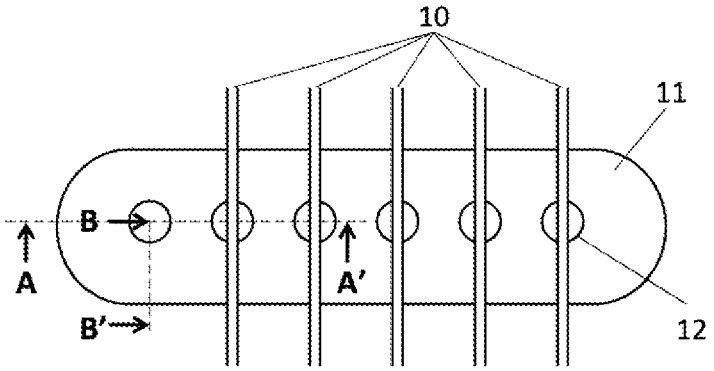
FIG. 1 illustrates a top view of SC pickup
Figure 2:
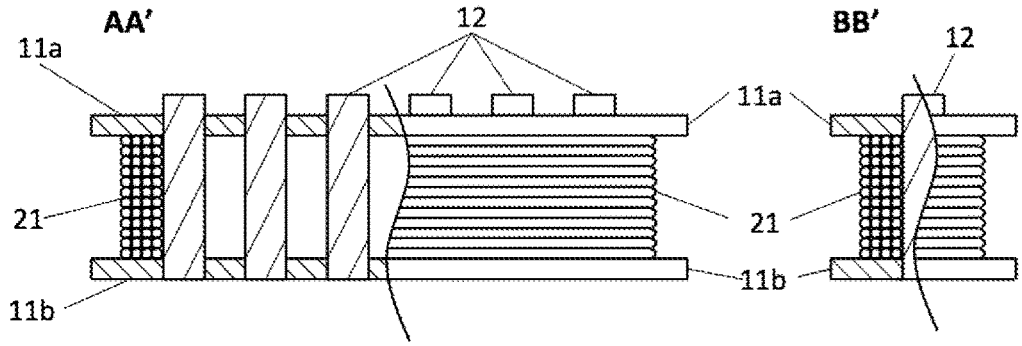
FIG. 2 illustrates diagrams of pole set/bobbin and wire assembly of SC pickups in two popular arrangements
Figure 2:
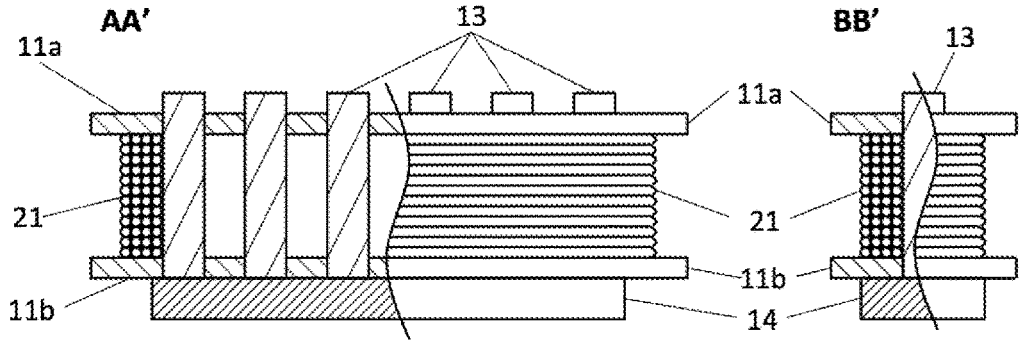

FIG. 1 shows a top view of a SC pickup placed underneath strings 10. The corresponding side views and partial cross-sectional diagrams are illustrated in FIG. 2. The pickup shown in the figures comprises of top bobbin plate 11*a*, bottom bobbin plate 11*b*, permanent magnet pole pieces 12 or ferromagnetic pole pieces 13, a magnet bar 14, and magnetic wire coil 21. Two bobbin plates, 11*a* and 11*b*, hold straight a set of pole pieces, 12 or 13, and the coil 21 is wound around the pole pieces 12 or 13. A magnetic field is generated by permanent magnet pole pieces 12 so that the vibration of the strings 10 is converted to electrical signal through the coil wire 21. When ferromagnetic pole pieces 13 are used, a magnetic bar 14 is situated under the assembly of pole pieces 13 and bottom bobbin plate 11*b* to generate a similar magnetic field.

Figure 3:
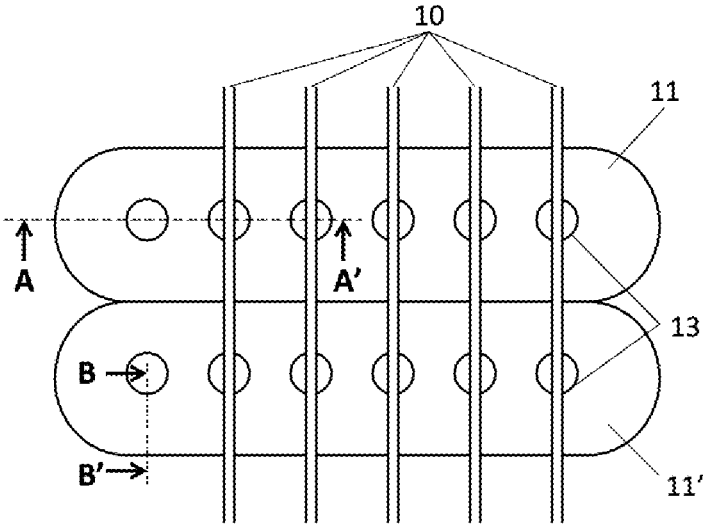
FIG. 3 illustrates a top view of HB pickup
Figure 4:
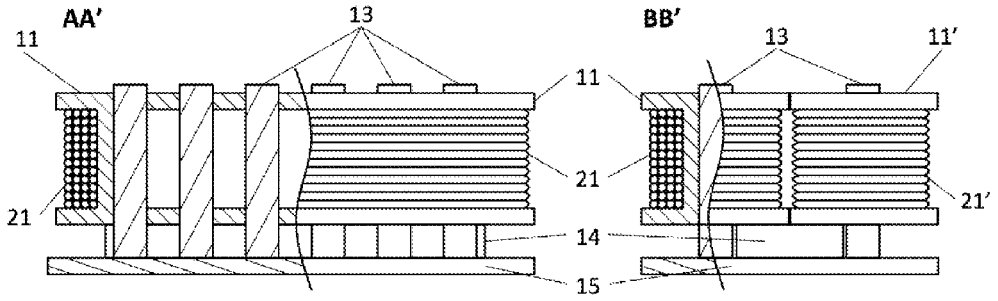
FIG. 4 illustrates a diagram of pole piece/bobbin/coil assembly of HB pickup

FIG. 3 shows a top view of a HB pickup placed underneath strings 10. The corresponding side view and partial cross-sectional diagram are illustrated in FIG. 4. Ferromagnetic pole pieces 13 are put inside and run through two bobbins, 11 and 11', made of molded plastic. A magnet bar 14 is situated on the bottom side of the bobbins 11 and 11'. In the original PAF structure, one of the two bobbins, 11 or 11', holds screw-type pole pieces. In this document all pole pieces 13 are described as straight cylinders for convenience sake in illustration of the present invention. The magnetic bar 14 is sandwiched by two rows of extended ferromagnetic pole pieces 13 such that two pole piece sets 13 of two bobbins, 11 and 11', are induced with opposite magnetic polarities generating a closed circuit of magnetic field. The base plate 15 is placed under the magnet 14 and pole pieces 13 to hold them in place. Two magnetic wire coils, 21 and 21', whose specifications can be identical or different, are wound around two bobbins, 11 and 11', respectively. The magnetic wire used in both SC and HB pickups is generally a copper or silver wire coated with thin polymeric insulation. Hereinafter, the magnetic wire coil will be referred to as simply "coil".

Figure 5:
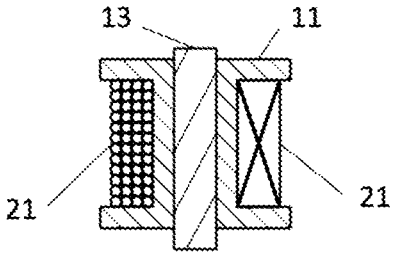
FIG. 5 illustrates a simplified diagram of pole piece/bobbin/coil assembly

In order to illustrate the embodiment of the present invention more effectively a simplified diagram is used for coils. FIG. 5 shows a cross-sectional view across BB' in FIG. 4 and includes a bobbin 11, a pole piece 13 and a coil 21. On the right-hand side the coil 21 is simplified as a box with two crossing lines. The following figures will use this simplified convention.

Figure 6:
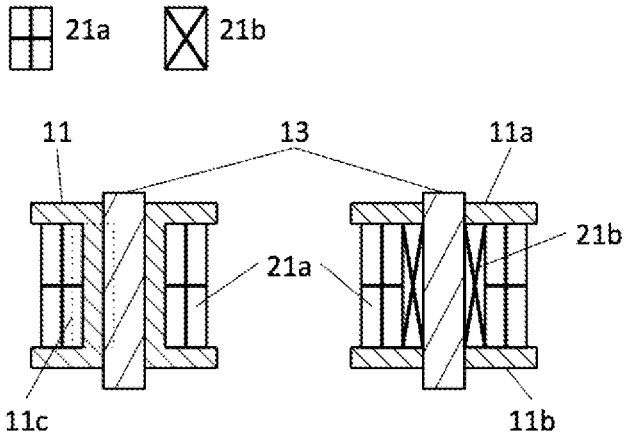
FIG. 6 illustrates simplified diagrams of traditional HB pickup bobbin assembly (left) and new HB pickup bobbin assembly proposed in the present invention (right)

FIG. 6 illustrates the basic idea of this invention. The bobbin 11 for the HB pickup is generally made of molded plastic. It has holes for pole pieces 13 and those holes have a wall 11*c* with a certain thickness. The traditional SC pickup does not have such a wall 11*c* around pole pieces 12 or 13 because top and bottom plates, 11*a* and 11*b*, are separate parts and make up a bobbin shape by holding pole pieces 12 or 13 straight them. In this invention the wall space of pole piece holes 11*c* is replaced with an inner coil wire 21*b*. Then an outer coil 21*a* is wound on top of the inner coil 21*b*. The outer coil 21*a* and the inner coil 21*b* are electrically connected in-phase to produce a SC pickup sound that is fuller than a sound from a typical coil-split HB pickup. The pole piece/bobbin/coil arrangements with one coil and dual coils (inner and outer coils) are referred to as one-coil assembly and dual-coil assembly, respectively, hereinafter.

Figure 7:
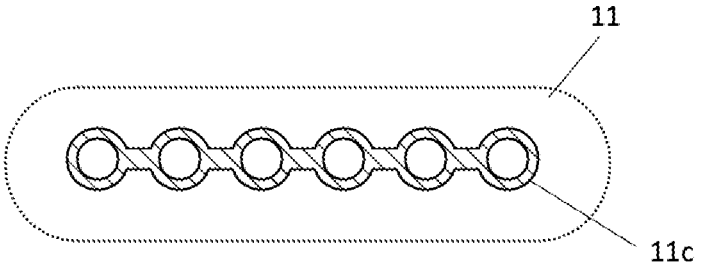
FIG. 7 illustrates an example of (a) plastic molded bobbin for traditional HB pickup and (b) plastic molded bobbin for dual-coil assembly with outward wall of pole piece holes removed.
Figure 7:
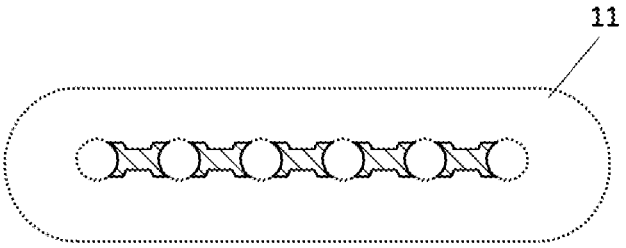

One way to eliminate the wall space 11*c* is to use separate top and bottom bobbin plates, 11*a* and 11*b*, combined with ferromagnetic pole pieces 13. It can be also realized with the molded plastic bobbin by eliminating the outward part of the pole piece hole wall 11*c*. FIG. 7(*a*) illustrates a cross-sectional view of an example of pole piece hole wall structure 11*c* in a traditional molded plastic bobbin 11 and FIG. 7(*b*) shows an example of the same after removing the outward wall of pole piece holes for embodiment of this invention. The bobbin shown in FIG. 7(*b*) can still be molded as one piece because the remaining wall structure can connect and support top and bottom plates, 11*a* and 11*b*.

It is important to note that this invention is applicable to any HB pickups wherein two pole piece/bobbin/coil assemblies are situated side by side. For example, this invention can be embodied into the "blade" pickup invented by Stich (U.S. Pat. No. 4,364,295 granted in 1982). In case of the blade pickup, the pole piece 13 illustrated in FIG. 6 represents a cross-section of a ferromagnetic blade pole piece.

In other embodiments, the wall thickness may be reduced instead of being completely removed to obtain a specific type of SC pickup tone while maintaining the specification of the outer coil 21*a*. In traditional HB pickups, the pole piece hole wall thickness for cylinder-type pole pieces 13 is about 0.8 mm. Therefore, the pole piece hole wall thickness, or in more general term, the minimum distance between the outer surface of pole pieces 13 and the innermost wires of the inner coil 21*b* must be smaller than 0.8 mm.

Figure 8:
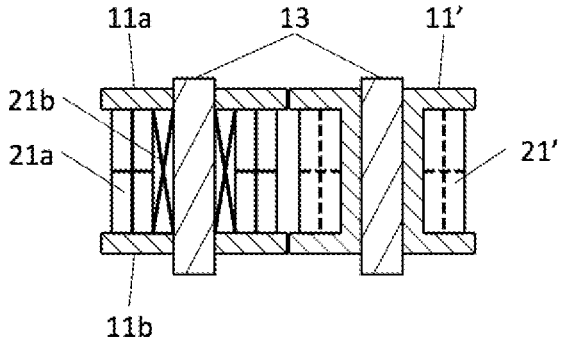
FIG. 8 illustrates examples of embodiment of the present invention onto (a) one and (b) both of pole piece/bobbin/coil assemblies of HB pickup
Figure 8:
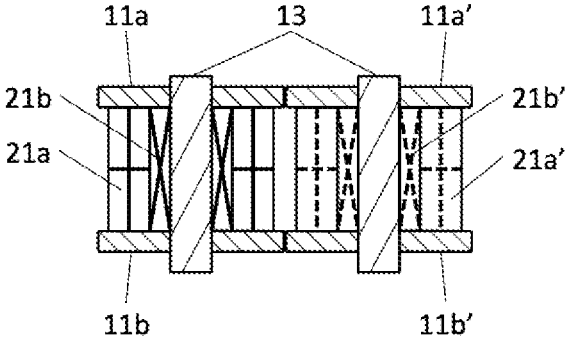

As illustrated in FIG. 8, one bobbin 11*a*/11*b* or both of bobbins, 11*a*/11*b* and 11*a*'/11*b*', can be wound with dual coils in a HB pickup. Note that two bobbin plates 11*a*/11*b* or 11*a*'/11*b*' can be separate top and bottom plates or a part of the single molded plastic piece as mentioned earlier. In case of the single dual-coil arrangement, the HB pickup sound is made by electrically connecting the outer coil 21*a* to the coil 21' in the other bobbin 11' out-of-phase. In case of the double dual-coil arrangement, a HB pickup sound is made by electrically connecting the outer coil 21*a* of one bobbin 11*a*/11*b* to the outer coil 21*a*' of the other bobbin 11*a*'/11*b*' out-of-phase. Practically, any coil (for example, outer coil 21*b*, inner coil 21*a*, or serially-connected inner and outer coils, 21*b* and 21*a*) wound around one bobbin 11*a*/11*b* can be combined with any coil of the other bobbin 11*a*'/11*b*'. Each pair of dual coils, 21*a*/21*b* or 21*a*'/12*b*', can be wound with its own specifications so that it should generate a unique SC pickup sound.

Figure 9:
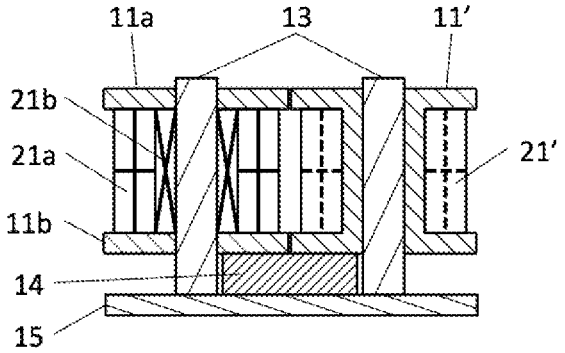
FIG. 9 illustrates an example of embodiment of the present invention onto HB pickup assembly with dual-coil assembly on the left side
Figure 10:
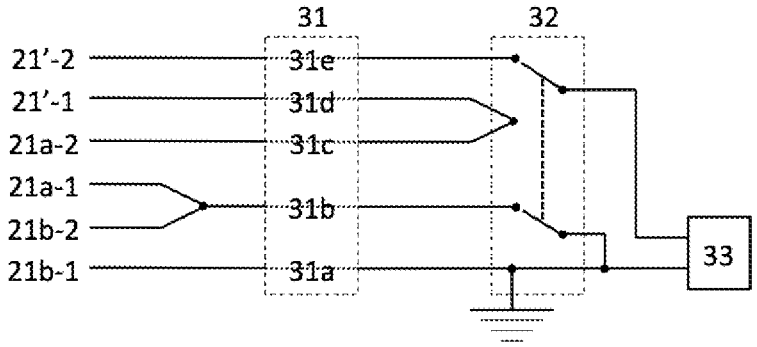
FIG. 10 illustrates an example of lead wiring of HB pickup with dual-coil assembly on one side

FIG. 9 shows a HB pickup structure employing one dual-coil assembly on the left side. This HB pickup has six outgoing wire tips due to the added inner coil 21*b*, whereas the traditional HB pickup has four outgoing lead wires. FIG. 10 illustrates an example of the coil wire tips, 21*a*-1, 21*a*-2,

21*b*-1, 21*b*-2, 21'-1 and 21'-2, connected to a shielded 4-conductor lead wire 31. The shielded 4-conductor lead wire 31 consists of ground 31*a* and four conductor wires, 31*b*, 31*c*, 31*d* and 31*e*. With the traditional HB pickup, four coil wire tips are soldered to those four conductor wires of the shielded lead wire 31. In the example illustrated in FIG. 10, two coil wires, 21*a* and 21', used for a HB pickup sound are connected to the lead wire 31 the same way, in which four coil wire tips, 21*a*-1, 21*a*-2, 21'-1 and 21'-2, are soldered to four conductor wires, 31*b*, 31*c*, 31*d* and 31*e*, of the lead wire 31, respectively. The one tip of the inner coil 21*b*-1 is soldered to the ground wire 31*a* and the other tip 21*b*-2 to one tip of the outer coil 21*a*-1 electrically in-phase. The lead wire 31 is soldered onto a DPDT (Dual-Pole, Dual-Throw) toggle switch 32, such that the outer coil 21*a* of the dual-coil bobbin 11*a*/11*b* and the coil 21' of the other bobbin 11' are connected to an output circuit 33 at one side of the toggle switch 32 (upper toggle in FIG. 10) and the dual coils 21*a*/21*b* in series are connected to the same output circuit 33 at the other side of the toggle switch 32 (lower toggle in FIG. 10). More switches can be used to select tones from a HB pickup with double dual-coil assemblies or a combination of multiple HB pickups with dual-coil assemblies.

What is claimed is:

1. An electromagnetic pickup for stringed instruments comprising:

two bobbins disposed side by side;

a single or a plurality of ferromagnetic pole pieces running through the said bobbins;

a plurality of turns of an inner magnetic wire coil wound around one of the said two bobbins and a plurality of turns of an outer magnetic wire coil electrically connected in phase to and wound around the said inner magnetic wire coil after the said inner magnetic wire coil is wound;

a plurality of turns of one magnetic wire coil wound around the other bobbin;

a magnet disposed under the said bobbins such that the said pole piece or plurality of pole pieces of one bobbin are charged positive and the said pole piece or plurality of pole pieces of the other bobbin are charged negative;

a baseplate disposed under the said magnet.

2. The electromagnetic pickup of claim 1, wherein the said outer magnetic wire coil in one bobbin is electrically connected to the said one magnetic wire coil in the other bobbin out of phase to obtain hum-bucking pickup sound.

3. The electromagnetic pickup of claim 1, wherein the innermost wire of the said inner magnetic wire coil is in contact with the pole piece surface.

4. The electromagnetic pickup of claim 1, wherein the innermost wire of the said inner magnetic wire coil is not in contact with the pole piece surface and the distance between the innermost wire of the said inner magnetic wire coil and the pole piece surface is less than 0.8 mm.

5. An electromagnetic pickup comprising:

two bobbins disposed side by side;

a single or a plurality of ferromagnetic pole pieces running through the said bobbins;

a plurality of turns of inner magnetic wire coils wound around both of the said two bobbins and a plurality of turns of outer magnetic wire coils electrically connected in phase to and wound around the said inner magnetic wire coils after the said inner magnetic wire coils are wound;

a magnet disposed under the said bobbins such that the said pole piece or plurality of pole pieces of one bobbin are charged positive and the said pole piece or plurality of pole pieces of the other bobbin are charged negative;

a baseplate disposed under the said magnet.

6. The electromagnetic pickup of claim 5, wherein the outer magnetic wire coil in one bobbin is electrically connected to the outer magnetic wire coil in the other bobbin out of phase to obtain hum-bucking pickup sound.

7. The electromagnetic pickup of claim 5, wherein the innermost wire of the said inner magnetic wire coil in at least one of the said two bobbins is in contact with the pole piece surface.

8. The electromagnetic pickup of claim 5, wherein the innermost wires of the said inner magnetic wire coils in the said two bobbins are not in contact with the pole piece surface and the distance between the innermost wires of the said inner magnetic wire coils and the pole piece surface is less than 0.8 mm.

9. The electromagnetic pickup of claim 5, wherein the magnetic wire coils in the said two bobbins are identical or different in specifications.

* * * * *